US006690804B2

(12) United States Patent
Everett

(10) Patent No.: US 6,690,804 B2
(45) Date of Patent: Feb. 10, 2004

(54) LIGHTED MICROPHONE CABLE INDICATOR

(75) Inventor: Samuel Steven Everett, Collinsville, MS (US)

(73) Assignee: Peavey Electronics Corporation, Meridian, MS (US)

( * ) Notice: Subject to any disclaimer, the term of this patent is extended or adjusted under 35 U.S.C. 154(b) by 65 days.

(21) Appl. No.: 09/878,241

(22) Filed: Jun. 12, 2001

(65) Prior Publication Data

US 2002/0001190 A1 Jan. 3, 2002

Related U.S. Application Data

(60) Provisional application No. 60/214,805, filed on Jun. 28, 2000.

(51) Int. Cl.[7] ..... H04R 1/02; H04R 3/00

(52) U.S. Cl. ..... 381/91; 381/122; 381/172; 381/119; 362/86

(58) Field of Search ..... 340/825.25, 5.8, 340/825.49; 381/105, 104, 109, 110, 56, 58, 91, 92, 95, 111, 113, 118, 119, 122, 356, 172, 124; 362/86; 439/488, 490, 491

(56) References Cited

U.S. PATENT DOCUMENTS

| | | | | | |
|---|---|---|---|---|---|
| 3,992,584 | A | * | 11/1976 | Dugan | 381/119 |
| 4,396,800 | A | | 8/1983 | McDonnell et al. | 179/1 H |
| 4,567,608 | A | | 1/1986 | Watson et al. | 381/122 |
| 4,631,525 | A | * | 12/1986 | Serravalle, Jr. | 381/109 |
| 5,244,409 | A | | 9/1993 | Guss, III et al. | 439/490 |
| 5,289,355 | A | | 2/1994 | Cimock | 362/86 |
| 5,409,398 | A | | 4/1995 | Chadbourne et al. | 439/490 |
| 5,490,219 | A | | 2/1996 | Badie et al. | 381/122 |
| 5,608,807 | A | * | 3/1997 | Brunelle | 381/119 |
| 5,690,509 | A | | 11/1997 | Eisenbraun | 439/490 |
| 5,764,043 | A | | 6/1998 | Czosnowski et al. | 324/66 |
| 5,805,717 | A | | 9/1998 | Mills | 381/110 |
| 5,964,616 | A | | 10/1999 | Eisenbraun | 439/490 |
| 6,000,948 | A | | 12/1999 | Peterson | 439/22 |
| 6,317,503 | B1 | * | 11/2001 | Mercs et al. | 381/119 |
| 6,336,825 | B1 | | 1/2002 | Seefried | 439/488 |
| 6,454,226 | B2 | * | 9/2002 | Epping et al. | 381/363 |

OTHER PUBLICATIONS

JP 59–90487 (A) of Hiroyuki Kanai et al. for "Microphone With Display Device."

Product brochures and advertisements for CDS 4000 series Conference Discussion System by DIS (Danish Interpretation Systems), fall 2001. (5 pages).

* cited by examiner

*Primary Examiner*—Xu Mei
(74) *Attorney, Agent, or Firm*—Dykema Gossett PLLC

(57) ABSTRACT

A lighting apparatus for use with a microphone and a sound mixing system wherein each microphone has an associated channel located in the sound mixing system. Each microphone has a lighting means that assigns a particular color to that particular microphone and each channel has the same color associated with it as the color identifying the microphone. The color coding of the microphone and the channel allow for both to be visually identified. The apparatus has an audio connector for connecting the lighting apparatus to the microphone; a light source connected to the audio connector; a holder means for holding the light source; a power conductor for providing a pathway for power to the apparatus; and a strain relief connector for preventing the power conductor from being strained when the microphone is in use. The apparatus allows the microphone to be identified visually by the color it emits.

21 Claims, 3 Drawing Sheets

LIGHTED MICROPHONE CABLE INDICATOR

CROSS-REFERENCE TO RELATED APPLICATIONS

This application claims priority to a provisional patent application to Samuel S. Everette, Ser. No. 60/214,805, filed on Jun. 28, 2000.

BACKGROUND OF THE INVENTION

This invention relates generally to an apparatus for identifying a microphone by color and more particularly to a system for color coding a microphone or other audio sources such as musical instruments, and its associated mixing channel for identification purposes.

It is difficult for performers and sound engineers to quickly identify the microphones on stage when performers are moving around and there are multiple microphones and/or other audio sources available. Also, it is difficult for a sound engineer that is mixing the sound for various microphones to identify the proper channel for a performer if the performer is moving or if there are multiple performers with multiple microphones.

In a system having unidentified microphones or other audio sources, if a performer uses a different microphone after a break than the one they used prior to the break, the sound engineer must re-mix the microphone channel for that performer and the new microphone and other audio sources.

In order to avoid such redundancy of effort and possible confusion about which microphone belongs to which performer, the present system has been developed that identifies a specific microphone both to the performer and to the sound engineer at the mixing board by color coding both the microphone and its associated channel.

There currently exist various connectors for microphones that have a light identifying source, such as that one disclosed in the U.S. Patent to Peterson U.S. Pat. No. 6,000,948. The Peterson device is for a rotatable connector that is attached to a microphone which allows the microphone and the cord to be independently rotated thus preventing the cord from twisting and becoming tangled. There is a light emitting diode in the housing of a first connector that indicates to the user that the cord and microphone are electrically connected. Such system is different from the present invention because there is only a light source on the microphone, it is not color coded and there is no associated color source at the mixing board.

The McDonnell device, as disclosed in U.S. Pat. No. 4,396,800 is for a microphone switching device that provides a switch on a microphone handle attachment. The switch allows a performer on stage using a microphone to disconnect the microphone from the public address system so the performer can communicate directly with the backstage intercommunication system. There is a visual indicator that signals operation of the apparatus to the backstage personnel alerting them to a forthcoming message.

The present invention is for a system having a color coded light connected to the microphone cable close to the microphone so that a performer can easily associate a specific color with the specific microphone they are using. The sound channel on the mixing board that is associated with that particular microphone also has the same color associated therewith so that the channel for any particular microphone can be easily identified by matching it with the same color as shown in the color coded lighting means on the microphone cable.

SUMMARY OF THE INVENTION

It is an object of the present invention to provide an easy system for identifying a microphone or other audio source both to the performer on stage as well as the engineer off stage that is mixing the sound of the microphones and other audio sources.

Another object of the present invention is to provide a system for identifying a microphone by using color coded lighting means.

The objectives of the present invention are accomplished by an apparatus for use with a microphone and sound mixing system wherein each microphone has a channel in the sound mixing system. Each microphone has a lighting means that assigns a particular color to that particular microphone. Each channel of the sound mixer also has a color associated therewith. A performer using a microphone can identify their microphone by the unique color assigned to it and a sound engineer can also identify which microphone is associated with which performer by comparing the color on the microphone with the color on the channel on the mixing board.

Other objects, advantages and novel features of the invention will become more apparent from the following detailed description of the invention when taken in conjunction with the accompanying drawings.

DETAILED DESCRIPTION OF THE INVENTION

Figure 1:
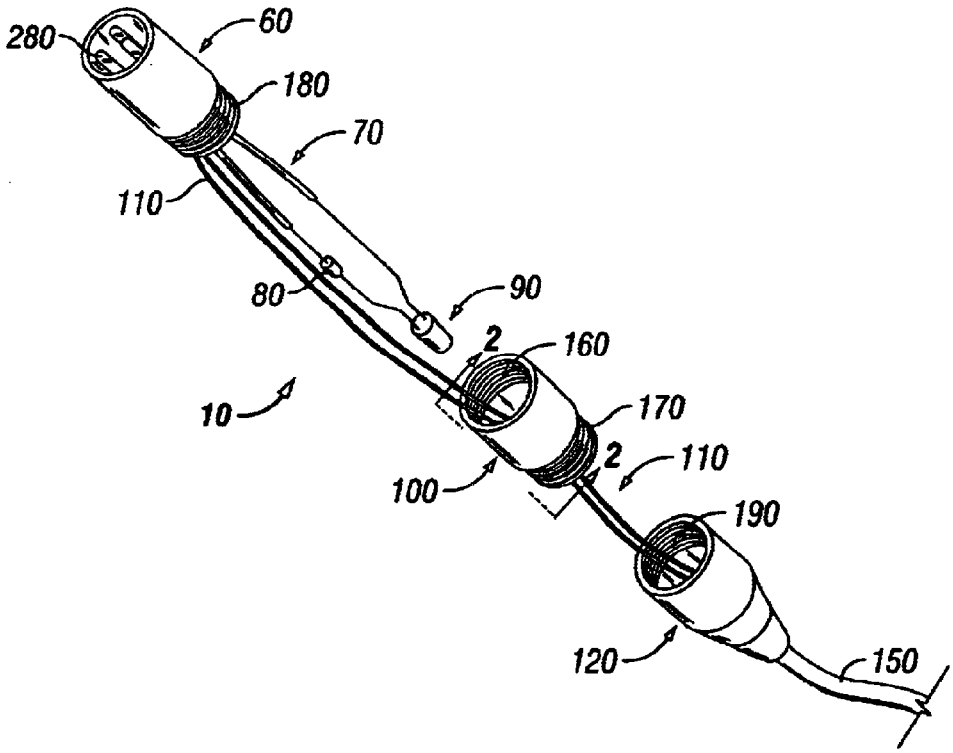
FIG. 1 is an exploded perspective view of the lighted microphone cable indicator of the present invention.

In the drawings, like reference characters refer to like and corresponding parts throughout the several views.

Figure 6:
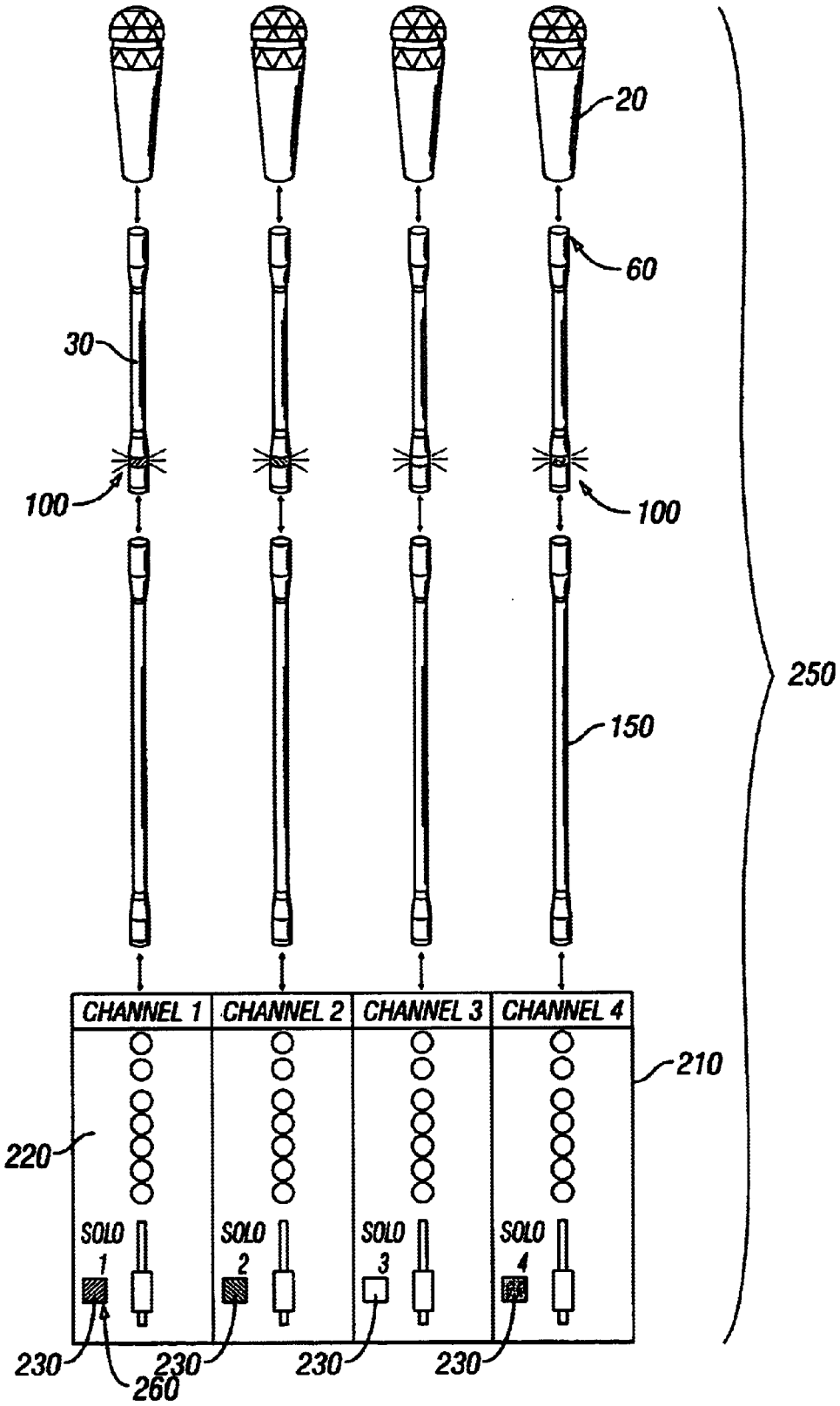
FIG. 6 is an exploded elevational view of a system of lighted microphone cable indicators of the present invention.

The lighted microphone cable indicator 10 has an audio connector 60 for connecting the lighted indicator 10 to a microphone 20 (FIG. 6). The preferred audio connector 60 is of a conventional female type connector that can readily be used with standard microphones 20. However, it is conceivable that the audio connector 60 can be a male type connector or even have fastening means such as threads, be friction fitted or other similar type connector.

A light source 90, such as an LED, lamp or other common source, is attached at one end to the audio connector 60 with a plurality of conductors 70 that facilitate power from the power source to the light source 90. The opposite end of the light source 90 is placed within the holder 100 and illuminates when in use, thus providing an identifying means or light for the microphone 20. The holder 100 is made of translucent material of various colors so that when the light source 90 is placed within the holder 100, the light source 90 will illuminate the holder 100. When the holder 100 is illuminated, it emits the color of the translucent material thereby color coding that particular microphone 20 so that it can be identified by the color of the holder 100.

The holder 100 can also be made of a transparent material wherein a colored light source 90, such as a colored light-bulb or light emitting diode (LED), is placed in the holder 100 and the holder 100 is lit up in the color of the light source 90.

It is also possible to place multiple holders 100 adjacent one another with different colors, such as one being red and another being blue, so that color combinations can be used for identification purposes, and not simply a single color, which may be useful if a large number of performers are present or the colors are limited to a few.

A control element 80 is located in line between the light source 90 and the audio connector 60. The control element 80 allows control of the brightness of the light source 90 as desired and is a component of conventional means.

The holder 100 for supporting the light source 90 is located adjacent the audio connector 60. The holder 100 has a connector 160 at one end that matingly fits with a connector 180 on the audio connector 60. The opposite end of the holder 100 also has a connector 170 that matingly connects with a connector 190 on the strain relief means 120. As shown in the drawings, the preferred connectors are threaded connecting means, but other conventional types of connectors known in the art may easily be used.

The holder 100 has a housing 200 that is transparent and colored so that when the light source 90 is placed within the housing 200 in a recess 130 especially designed to hold the light source 90, light will be emitted illuminating the housing 200 and color coding the microphone 20.

Figure 2:
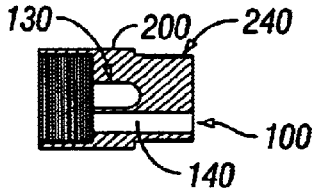
FIG. 2 is a cross sectional view of the light source holder means of the present invention, taken along line 2—2 in FIG. 1.
Figure 3:
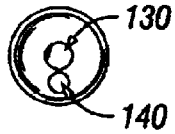
FIG. 3 is an end elevational view of the light source holder means.
Figure 4:
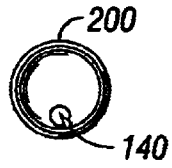
FIG. 4 is an opposite elevational view of the light source holder means.

As shown in FIGS. 2–4, a hole 140 is also located within the housing 200 of the light source 100 which allows for the conductors 110 to pass through the holder 100 and provide a direct path for power to run from the strain relief means 120 to the audio connector 60. The hole 140 extends completely through the holder 100 from one end to the other end. The housing 200 is contoured 240 to matingly fit with the strain relief connector 120 and provide a secure and snug fit therein.

A power conductor 110 provides a conduit or pathway for power to travel through the light indicator 10 from the power source to the microphone 20.

A strain relief connector 120 is attached at the end of the holder 100 opposite the audio connector 60. The strain relief connector 120 is connected directly to the holder 100 on one end, and to the power cable 150 at the other end. This connector 120 prevents the power cable 150 from being dislodged, strained or pulled loose when the microphone 20 is moved around.

Figure 5:
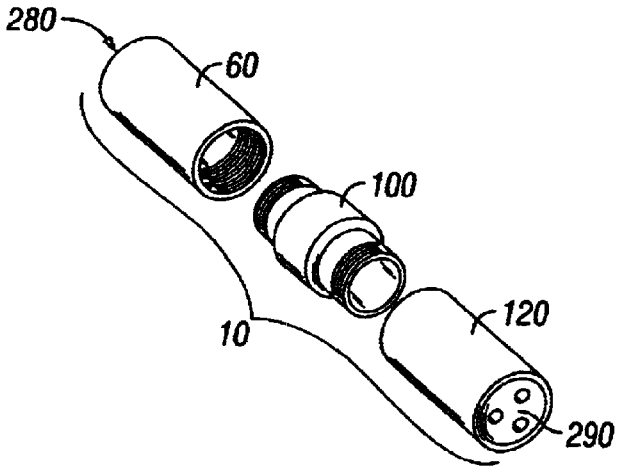
FIG. 5 is a perspective view of an alternate embodiment of the lighted microphone cable indicator.

An alternate embodiment of the lighted microphone cable indicator 10 is shown in FIG. 5. This embodiment of the cable indicator 10 allows the cable indicator 10 to be easily interchangeable and used in a variety of systems due to the strain relief means 120 having a removable connecting means 290.

The cable connector 10, as with the previously described embodiment, has an audio connector device means 60 at one end, a strain relief means 120 at the opposite end, with a light source means holder 100 located therebetween. In this embodiment, both the audio connector device means 60 and the strain relief means 120 have connection elements that allow for the cable indicator 10 to be easily added to or taken out of the identification system 250. As shown in FIG. 5, but not limited in scope thereto, the audio connector device means 60 has a male connector 280 while the strain relief means 120 has a female connector 290.

Each lighted microphone cable indicator 10 is located between the microphone 20 and a mixer 210, as shown in FIG. 6. All the connecting means in this lighted indicator 10 can be of various conventional types and not limited to those shown in the preferred embodiment thereby allowing the lighted indicator 10 to be used with various types of mixer 210, cables 150 and microphones 20.

When the identification system 250 is used, it is in a microphone sound system having a sound mixing board 210 with a plurality of channels 220 that accommodates a plurality of microphones 20. (See FIGS. 6 & 7). Each specific microphone 20 has an associated channel 220. A colored light source holder 100 is attached to each microphone 20 thereby assigning a particular color, i.e. green, to that particular microphone 20.

An identification strip 230 having the same color, i.e. green, as the light source holder 100, is attached to the associated mixing channel 220 on the mixer 210 thereby allowing both the channel 220 and the microphone 20 to be easily identified by the color. The color green is used for illustrative purposes only, any color may be used and even the same colors can be used. For example, there may be one color used for back-up singers while a different color is used for the lead singer.

The identification strips 230 are removable thereby allowing the color to be altered with each new person using the microphone 20.

In the present identification system 250, the identification strip 230 is attached to the mixing board 210 by a connecting means 260 such as a magnet, however it is within the scope of this invention for such connecting means to be of any conventional type such as, and not limited to, screws, bolts, hook and loop fasteners, snaps, adhesives, and even slots or holders for the identification strip 230 to slide into.

Figure 7:
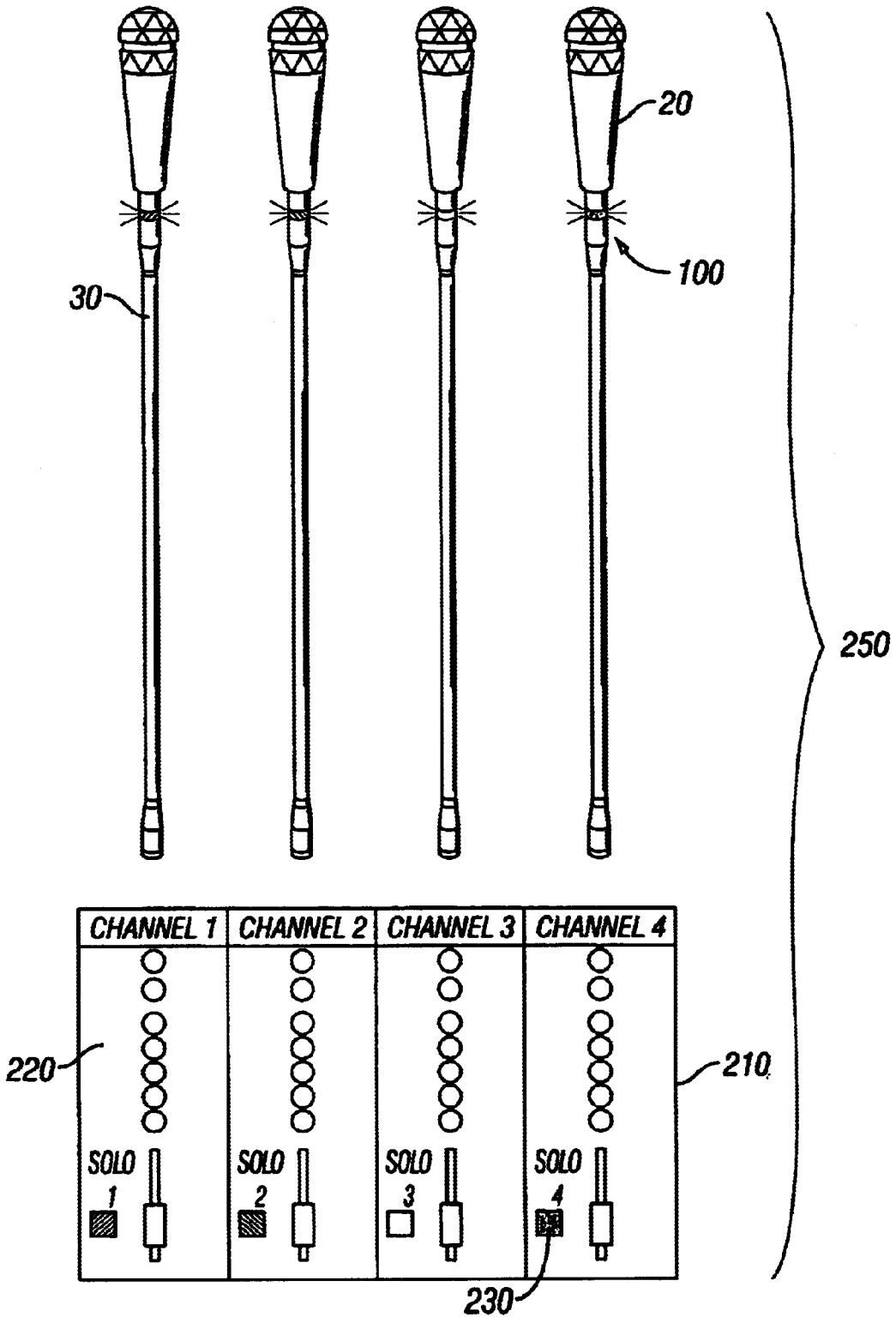
FIG. 7 is an exploded elevational view of a second embodiment of the system of lighted microphone cable indicators of the present invention.

FIG. 7 is a second embodiment of the invention that shows the light source holder 100 located directly adjacent the microphone 20, instead of further down the microphone cable 30 as shown in FIG. 6.

Since the light source holder 100 is easily replaceable, the color associated with that microphone 20 can be changed as desired. Also, the location of the light source holder can be varied depending upon the needs of the performer and/or sound engineer. For example, there may be times when the light source holder 100 would be needed to be located adjacent the microphone 20 because it is more visible in that location than a location further down the microphone cable 150.

Although a particular embodiment of the invention has been described in detail herein with reference to the accompanying drawings, it is to be understood that the invention is not limited to this precise embodiment, and that various changes and modifications may be effected therein by one skilled in the art without departing from the scope or spirit of the invention as defined in the appended claims.

What is claimed is:

1. A lighting apparatus for use in a microphone system, the apparatus to be attached to a microphone cable and used to identify a particular microphone, the apparatus comprising:

an audio connector for connecting the lighting apparatus to a microphone;

a colored light source connected to said audio connector;

a translucent holder for holding said light source;

a power conductor for providing a pathway for power to said lighting apparatus;

a strain relief means for preventing said power conductor form being stained, said holder becoming illuminated when said light source is energized to enable visual identification of the microphone from a location remote from the microphone;

a control means for controlling the brightness of said light source, said control means being located on said power conductor; and a power source for providing power to said lighting apparatus.

2. The lighting apparatus of claim 1, wherein:

said holder is made of translucent material; and said light source is colored.

3. The light apparatus of claim 2, wherein:

said light source is a light bulb.

4. The lighting apparatus of claim 2, wherein:

said light source is a light emitting diode.

5. The lighting apparatus of claim 1, wherein:

said holder is made of translucent material.

6. The lighting apparatus of claim 5, wherein:

said translucent material is colored.

7. The lighting apparatus of claim 6, further comprising:

a control means for controlling the brightness of said light source, said control means being located on said power conductor.

8. The lighting apparatus of claim 7, further comprising:

a power source for providing power to said lighting apparatus.

9. An identification system for identifying a particular microphone and its associated mixing channel within a sound mixing system, said identification system comprising:

at least one microphone;

at least one microphone lighting apparatus having an audio connector for connecting the lighting apparatus to said microphone a light source connected to said audio connector, a holder means for holding said light source, a power conductor for providing a pathway for power to said microphone, and a strain relief means for preventing said power conductor from being strained, wherein said light source is used to identify the microphone visually;

a mixing board, said mixing board having at least one channel and at least one identification strip;

at least one microphone cable for connecting said microphone with said mixing board;

wherein said light source and said holder means from the identifying system for identifying a particular microphone and associating it with a particular channel in the mixing board.

10. The identification system of claim 9, wherein:

said holder is made of translucent material; and said light source is colored.

11. The identification system of claim 10, wherein:

said at least one lighting apparatus further comprising a control means for controlling the brightness of said light source, said control means being located on said power conductor.

12. The identification system of claim 11, further comprising:

a power source for providing power to said at least one lighting apparatus and said at least one microphone.

13. The identification system of claim 9, wherein:

said holder is made of translucent material.

14. The identification system of claim 13, wherein:

said translucent material is colored.

15. The identification system of claim 14, wherein:

said at least one lighting apparatus having a control means for controlling to brightness of said light source, said control means being located on said power conductor.

16. The identification system of claim 15, further comprising:

a power source for providing power to said at least one microphone and said at least one lighting apparatus.

17. An identification system for identifying a microphone and a related mixing channel within a mixing board, said identification system comprising:

a microphone;

a first identification means connected to said microphone including a light source and a holder for holding the light source, said holder, being illuminated when the light source is energized to enable visual identification of the microphone from a location remote therefrom;

a mixing board having a channel that is for controlling said microphone;

a second identification means connected to said mixing board;

wherein said first identification means identifies said microphone and said second identification mean identifies said related channel such that said microphone can be identified and associated with said identified and related channel, and wherein said first identification means is a lighting apparatus having an audio connector for connecting the lighting apparatus to said microphone, the light source being connected to said audio connector, a power conductor for providing a pathway for power to said microphone, and a strain relief means for preventing said power conductor from being strained, a microphone able for connecting said microphone with said mixing board; and said second identification means is an identification strip.

18. An identification system as claimed in claim 17, wherein:

said light source is colored;

said identification strip is colored;

wherein the color of said light source is the same as the color of said identification strip.

19. An identification system as claimed in claim 17, wherein:

said holder means is colored;

said identification strip is colored, wherein the color of said holder means is the same as the color of said identification strip.

20. A lighting apparatus for use in a microphone system, the apparatus to be attached to a microphone cable and used to visually identify a particular microphone, the apparatus comprising:

an audio connector for connecting the lighting apparatus to a microphone;

a light source connected to said audio connector;

a holder formed of translucent material for holding said light source;

a power conductor for providing a pathway for power to said lighting apparatus;

a control located on the power conductor coupled to the light source for controlling brightness of said light; and a strain relief means for preventing said power conductor from being strained.

21. An identification system for identifying a microphone and a related mixing channel within a mixing board, said identification system comprising:

a microphone;

a first identification means connected to said microphone including;

an audio connector for connecting the lighting apparatus to said microphone, a light source connected to said audio connector, a holder for holding said light source, a power conductor for providing a pathway for power to said microphone, and a strain relief means for preventing said power conductor from being strained, wherein said light source is used to identify the microphone visually;

a mixing board having a channel that is for controlling said microphone;

a second identification means connected to said mixing board;

wherein said first identification means visually identifies said microphone and said second identification means identifies said related channel such that said microphone can be identified and associated with said identified and related channel; and wherein said second identification means comprises of an identification strip.

* * * * *